United States Patent [19]

Amos

[11] 4,015,358

[45] Apr. 5, 1977

[54] CARTRIDGE STORING AND LOADING DEVICE FOR A REVOLVER

[75] Inventor: Richard Wayne Amos, Arcadia, Calif.

[73] Assignee: Van Zandt Precision Products, Inc., Azusa, Calif.

[22] Filed: Feb. 2, 1976

[21] Appl. No.: 654,090

[52] U.S. Cl. ..... 42/87; 42/90; 224/13

[51] Int. Cl.[2] ..... F41C 27/00

[58] Field of Search ..... 42/89, 87, 88, 90; 206/3; 224/13, 17, 20, 21

[56] References Cited

UNITED STATES PATENTS 2,526,195 10/1950 Brownsey ..... 42/87

2,920,893 1/1960 Walker ..... 42/87

*Primary Examiner*—Charles T. Jordan

*Attorney, Agent, or Firm*—Christie, Parker & Hale

[57] ABSTRACT

A storing and loading device for cartridges used in a revolver. A first plate has a plurality of holes in which the cartridges are inserted with the bullet end down. The plate is supported above a base having a surface parallel to the plate, the plate being held away from the surface by springs. The cartridges are removed by pressing the plate downwardly against the springs so that the bullets engage the surface and lift the other end of the cartridges out of the supporting holes.

5 Claims, 3 Drawing Figures

Fig. 1
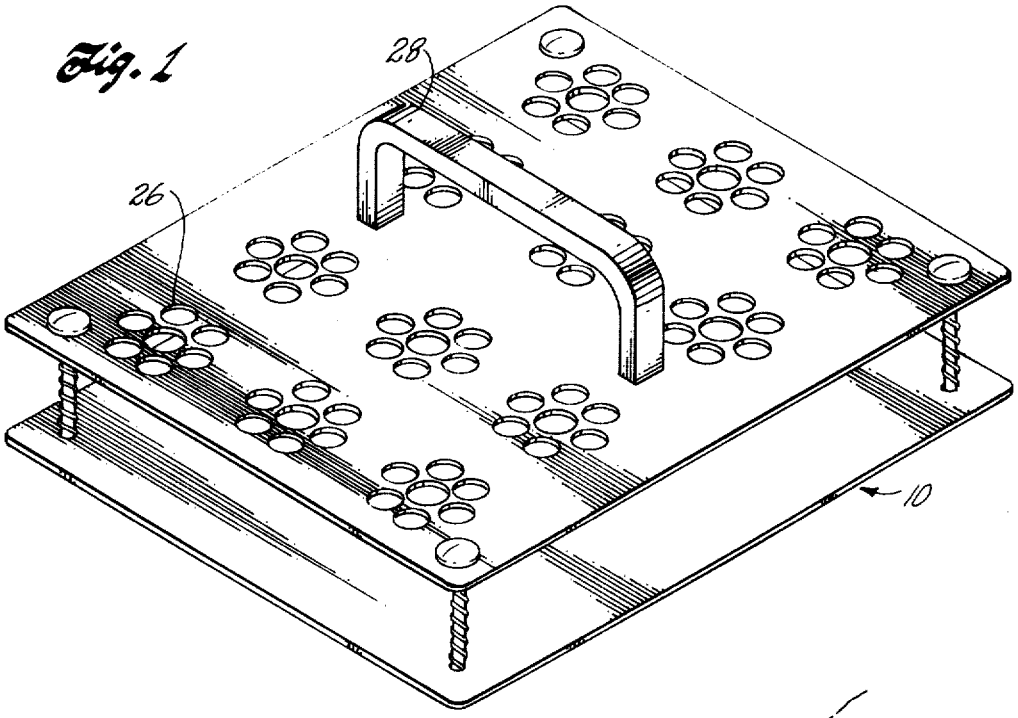
Fig. 2
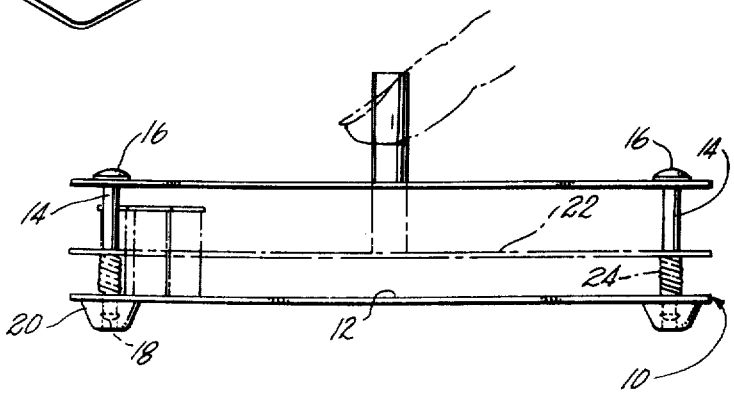
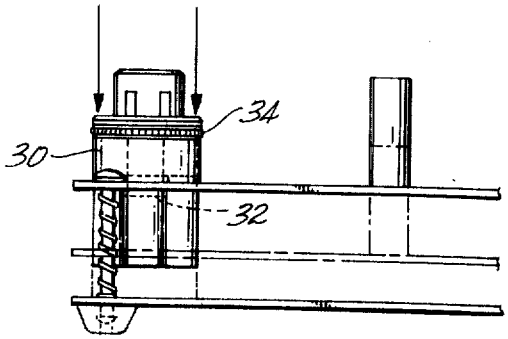
Fig. 3

CARTRIDGE STORING AND LOADING DEVICE FOR A REVOLVER

FIELD OF THE INVENTION

This invention relates to devices for storing and loading cartridges in a revolver or the like.

BACKGROUND OF THE INVENTION

In competitive pistol shooting, the participant may be called upon to compete against the clock in getting off a number of shots. Since the standard revolver must be reloaded after firing six shots, various devices have been proposed for rapid loading of a full complement of cartridges in the cylinder of a revolver at one time. One such known rapid loading device, for example, is described in U.S. Pat. No. 3,541,716. Where a number of rounds are to be fired in rapid succession, the participant either must stop to reload the rapid loader, or must have a number of preloaded rapid loaders on hand. This means that not only must the user invest in a number of rapid loader units, but he must provide some convenient means of storing the rapid loader units and bullets at the firing location.

SUMMARY OF THE INVENTION

The present invention is directed to a device for storing and carrying a relatively large number of cartridges with the cartridges being stored in groups which can easily be loaded either manually into the cylinder of the revolver or loaded as a group simultaneously into a rapid loader device from which they can be transferred in a group to the cylinder of the revolver. The present device permits a full complement of cartridges to be stored and transferred as a group to load a revolver with a full complement of cartridges.

To this end, the present invention provides a device including a thin plate in which are arranged a plurality of holes. The holes are preferably positioned in groups corresponding in number to the full complement of cartridges to be transferred to a revolver, with the holes being of the same size and in the same pattern as the holes in the cylinder barrel of the revolver. This plate is supported above a base having a parallel flat surface spaced from the plate a distance slightly greater than the length of the cartridges. Spring means allows the plate to be urged toward the flat surface, causing the bullet end of the cartridges inserted in the holes in the plate to come in contact with the flat surface, lifting the cartridges out of the holes.

DESCRIPTION OF THE DRAWINGS

For a more complete understanding of the invention reference should be made to the accompanying drawings, wherein:

FIG. 1 is a perspective view of the cartridge storing and loading device of the present invention;

FIG. 2 is a side elevational view; and

FIG. 3 is a side elevational view showing the device of the present invention used in combination with a rapid loader.

DETAILED DESCRIPTION

Referring to the drawings in detail, the numeral 10 indicates generally a base plate 10 which is preferably made of a relatively stiff metal plate providing a flat top surface 12. Projecting upwardly at each of the corners of the frame plate 10 are four guide members 14 having heads 16 at their upper ends. The guide members 14 are fastened to the base plate 10 by screws 18 which extend upwardly through rubber supports 20 and through holes in the base plate 10 into threaded openings in the ends of the guide members 14.

A cartridge supporting plate 22 is movably supported on the guide members 14 by coil springs 24 positioned between the plates 10 and 22. The springs 24, which are concentric with and held in place by the guide members 14, urge the cartridge supporting plate 22 upwardly against the heads 16 of the guide member 14.

The cartridge supporting plate is provided with a plurality of holes arranged in groups, as indicated at 26. Preferably the holes in each group are arranged in the pattern of holes in the loading end of the revolver cylinder of the pistol with which the unit is to be used. For example, there may be six holes arranged in a circle, corresponding to the six cartridge chambers in the cylinder of a revolver, plus a center hole. Cartridges are stored in the device by inserting the cartridges with the bullet end inserted downwardly through the hole. The cartridge is supported by the plate 22 by the standard flange at the cap end of the cartridge, as shown in FIG. 2. The bullet end of the cartridge normally is spaced from the surface 12. Once loaded with cartridges, the device can be conveniently carried by means of a handle 28 secured to the top of the cartridge supporting plate 22.

To remove cartridges from the device, the user can press down on the handle 28, depressing the plate 22 against the springs 24. This brings the bullet end of the cartridges into engagement with the surface 12, and in effect lifting the cap ends of the cartridges free of the plate 22 as the plate 22 is depressed further towards the surface 12. The cartidges can then be easily gripped to remove them from the storing device and inserting them in the revolver chamber.

The cartridge storing device is particularly useful when loading bullets into a rapid revolver loader of the type described in the above-identified patent. Such a device is indicated generally at 30 in FIG. 3. The rapid loader includes a centering projection 32 which is inserted in the center hole of a group of holes 26 storing cartridges. By pressing down on the outer edges of the rapid loader, as indicated by the arrows in FIG. 3, the plate 22 is depressed, bringing the cartridges into contact with the surface 12. As the rapid loader is continued to be pressed downwardly, the cartridges stored in the group of holes are pushed upwardly into the rapid loader 30 where the flanges at the upper ends of the cartridges come in contact with a retaining spring 34, in the manner described in detail in the above-identified patent. Thus a full complement of cartridges are simultaneously loaded into the rapid loader 30 from which they can be inserted as a group into the chambers of the revolver cylinder.

Although cartridges stored in other groups of holes are partially lifted out of the holes by depresssing the plate 22 against the spring 24, these cartridges fall back in place when the plate 22 is released and allowed to return to the normal position against the head 16 of the guides 14. It will be further noted from FIG. 3 that when the rapid loader 30 is pressed downwardly against the plate 22 at a group of holes near one margin of the plate 22, the plate is canted, since the adjacent edge of the plate tends to be depressed against the springs 24 much more than the remote edge. Sufficient clearance is provided between the guides 14 and the holes in the plate 22 through which the guides pass to permit the plate 22 to be canted in this fashion.

From the above description it will be seen that the present invention provides a device for storing a large number of cartridges in a manner which makes it easy to transfer the cartridges to a revolver. Typically as many as twelve groups of holes may be provided in the plate 22, permitting twelve complements of cartridges to be stored at one time. The unit can be conveniently carried by the handle 28 in a fully loaded condition. Cartridges can be either transferred by hand from the device and inserted in the revolver in a conventional manner, or the cartridges can be loaded one complement at a time into a rapid loader device for transfer to the cylinder of a revolver. While the invention has been described in connection with a loader of the type described in the above-identified patent, other well known rapid loaders can be used, if desired.

What is claimed is:

1. A fixture for storing and simplifying the loading of cartridges in the cartridge chamber of a revolver, comprising a flat frame plate, a flat cartridge supporting plate, guide members movably supporting the supporting plate from and in parallel relationship to the frame plate, the guide members permitting movement of the parallel plates toward each other, stop means for limiting the separation of the frame plate and supporting plate, and spring means urging the plates away from each other against the stop means, the supporting plate having a plurality of groups of holes for receiving the cartridge to be loaded, the holes in each group corresponding in size and arrangement to the cartridge chambers in the revolver to be loaded from the fixture.

2. The fixture of claim 1 further including a handle connected adjacent the center of the cartridge supporting plate for carrying the fixture with the cartridge supporting plate above the frame.

3. The fixture of claim 2 further including support means attached to the bottom of the frame plate for supporting the fixture.

4. A cartridge storing and loading device for a revolver, comprising a supporting member having a flat surface, a thin plate having a plurality of holes adapted to receive cartridges inserted in the holes, and spring means supporting the plate above said surface by an amount slightly greater than the length of the cartridges to be stored, the spring means yieldably urging the plate away from said surface while permitting the plate to be pushed toward said surface to bring the lower ends of the stored cartridges into contact with the flat surface.

5. Apparatus of claim 4 further including handle means attached to said plate for carrying the device and for pressing the plate toward the surface to extract the cartridges from the holes.

* * * * *